US010384473B2

(12) United States Patent
Hachmann et al.

(10) Patent No.: US 10,384,473 B2
(45) Date of Patent: Aug. 20, 2019

(54) DIGITAL PRINTING MACHINE WITH A TEMPERATURE CONTROL DEVICE FOR SHEETS

(71) Applicant: HEIDELBERGER DRUCKMASCHINEN AG, Heidelberg (DE)

(72) Inventors: Peter Hachmann, Weinheim-Hohensachsen (DE); Rolf Mueller, Nussloch (DE); Thomas Schmidt, Heidelberg (DE); Michael Pritschow, Idar-Oberstein (DE); Peter Thoma, Mannheim (DE); Kai Oskar Mueller, Birkenau (DE); Michael Gieser, Oftersheim (DE); Timo Erben, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/969,284

(22) Filed: May 2, 2018

(65) Prior Publication Data

US 2018/0326750 A1 Nov. 15, 2018

(30) Foreign Application Priority Data

May 11, 2017 (DE) ..... 10 2017 207 953

(51) Int. Cl.

| | |
|---|---|
| ***B41J 11/00*** | (2006.01) |
| ***B41J 11/04*** | (2006.01) |
| ***B41J 13/02*** | (2006.01) |

(52) U.S. Cl.
CPC ..... *B41J 11/002* (2013.01); *B41J 11/0095* (2013.01); *B41J 11/04* (2013.01); *B41J 13/02* (2013.01)

(58) Field of Classification Search
CPC ..... B41J 11/002; B41J 11/04; B41J 11/0095; B41J 13/02
See application file for complete search history.

(56) References Cited

U.S. PATENT DOCUMENTS

| | | | |
|---|---|---|---|
| 2009/0322824 | A1 | 12/2009 | Hori |
| 2013/0027484 | A1 | 1/2013 | Fukui |
| 2013/0328989 | A1 | 12/2013 | Thayer et al. |

FOREIGN PATENT DOCUMENTS

| | | | |
|---|---|---|---|
| EP | 2551122 | A1 | 1/2013 |
| EP | 2650132 | A1 | 10/2013 |

*Primary Examiner* — Julian D Huffman
(74) *Attorney, Agent, or Firm* — Laurence A. Greenberg; Werner H. Stemer; Ralph E. Locher

(57) ABSTRACT

A digital printing machine includes a first cylinder for transporting sheets, a second cylinder for transferring the sheets directly to the first cylinder, a third cylinder for transferring the sheets directly to the second cylinder, and at least one inkjet print head directed towards the first cylinder for printing on the sheets disposed thereon. At least one first sensor measures the temperature of the first cylinder, a second sensor measures the temperature of the sheets while being transported by the second cylinder or by the third cylinder, and at least one temperature control device controls the temperature of the sheets prior to their transfer to the first cylinder. A control element adapts the temperature of the sheets to the temperature of the first cylinder. The first sensor, the second sensor and the temperature control device are connected to the control element.

10 Claims, 3 Drawing Sheets

DIGITAL PRINTING MACHINE WITH A TEMPERATURE CONTROL DEVICE FOR SHEETS

CROSS-REFERENCE TO RELATED APPLICATION

This application claims the priority, under 35 U.S.C. § 119, of German Patent Application DE 10 2017 207 953.3, filed May 11, 2017; the prior application is herewith incorporated by reference in its entirety.

BACKGROUND OF THE INVENTION

Field of the Invention

The present invention relates to a digital printing machine including a first cylinder for transporting sheets, a second cylinder that transfers the sheets directly to the first cylinder, and at least one inkjet print head directed towards the first cylinder.

European Patent EP 2 551 122 B1, corresponding to U.S. Patent Application Publication 2013/0027484, describes an inkjet recording device having a transport drum that holds the recording medium on its circumferential surface by suction in order to transport it. The inkjet recording device further includes an inkjet head that creates an image on a front side of the recording medium by jetting aqueous ink. A cooling device is provided to cool the transport drum.

SUMMARY OF THE INVENTION

It is accordingly an object of the invention to provide a digital printing machine with a temperature control device for sheets, which overcomes the hereinafore-mentioned disadvantages of the heretofore-known devices of this general type.

With the foregoing and other objects in view there is provided, in accordance with the invention, a digital printing machine, comprising a first cylinder for transporting sheets, a second cylinder that transfers the sheets directly to the first cylinder, a third cylinder that transfers the sheets directly to the second cylinder, at least one inkjet print head directed towards the first cylinder to print on the sheets disposed thereon, at least one first sensor for measuring the temperature of the first cylinder, a second sensor for measuring the temperature of the sheets while being transported by the second cylinder or by the third cylinder, at least one temperature control device for controlling the temperature of the sheets before their transfer to the first cylinder, and a control element for adapting the temperature of the sheets to the temperature of the first cylinder, wherein the first sensor, the second sensor, and the temperature control device are connected to the control element.

An advantage of the invention is that adapting the sheet temperature to the temperature of the first cylinder on which the sheets are resting during the printing operation ensures that a high-quality printing process is possible. Temperature differences that exist within a respective sheet or between different sheets of an ongoing print job as a result of an acclimatization period that was too short may effectively be avoided, which is an added benefit of the invention.

Various further developments are possible.

The temperature control device may be a temperature control device for cooling and/or heating the sheets. The temperature control device may be disposed inside or outside a cylinder. If the temperature control device is inside a cylinder, the temperature control device controls the temperature of the sheets through contact with the circumferential cylinder surface. If the temperature control device is outside a cylinder, the temperature control device controls the temperature of the sheets in a contact-free way by irradiation. For instance, the temperature control device may be integrated into the second cylinder. Alternatively, the temperature control device may be integrated into the third cylinder. In addition to the aforementioned temperature control device, an additional temperature control device may be provided. In this case, the aforementioned temperature control device is integrated into the second cylinder and the additional temperature control device is integrated into the third cylinder.

The second sensor may be controlled in such a way that it measures the temperature of the respective sheet in a plurality of measurement locations that form a row extending in the direction of transport of the sheet. The second sensor may be connected to an initiation device that initiates a warning signal or sheet transport stop when a temperature differential between the measurement locations exceeds a specified threshold.

In another development a plurality of third sensors for measuring the temperature of the sheets are disposed in a row that extends in a direction transverse to the direction of sheet transport. The third sensors may be disposed in a sheet feeder. The third sensors may for instance be directed towards a stack formed by the sheets in the sheet feeder before the sheets are printed on. It is likewise possible to direct the third sensors towards a feed table on which the sheets coming from the stack are transported into a machine station downstream of the sheet feeder.

In accordance with a further development, a pressing device is provided to press the sheets against a circumferential cylinder surface, the temperature of which is controlled by the temperature control device. This temperature-controlled circumferential cylinder surface may be the circumferential surface of the second cylinder if the temperature control device is integrated in the second cylinder, or else it may be the circumferential surface of the third cylinder if the temperature control device is integrated into the third cylinder. The pressing effect of the pressing device may be achieved by contact with the sheet or in a contact-free way, for instance pneumatically by using blown air. The blown-air may be temperature-controlled and may for instance also be used to heat the sheet. The pressing device may for instance be a guide plate having blown-air nozzles for applying pressure without sheet contact. Alternatively, the pressing device may be an endless revolving belt for applying pressure with sheet contact.

Other features which are considered as characteristic for the invention are set forth in the appended claims.

Although the invention is illustrated and described herein as embodied in a digital printing machine with a temperature control device for sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
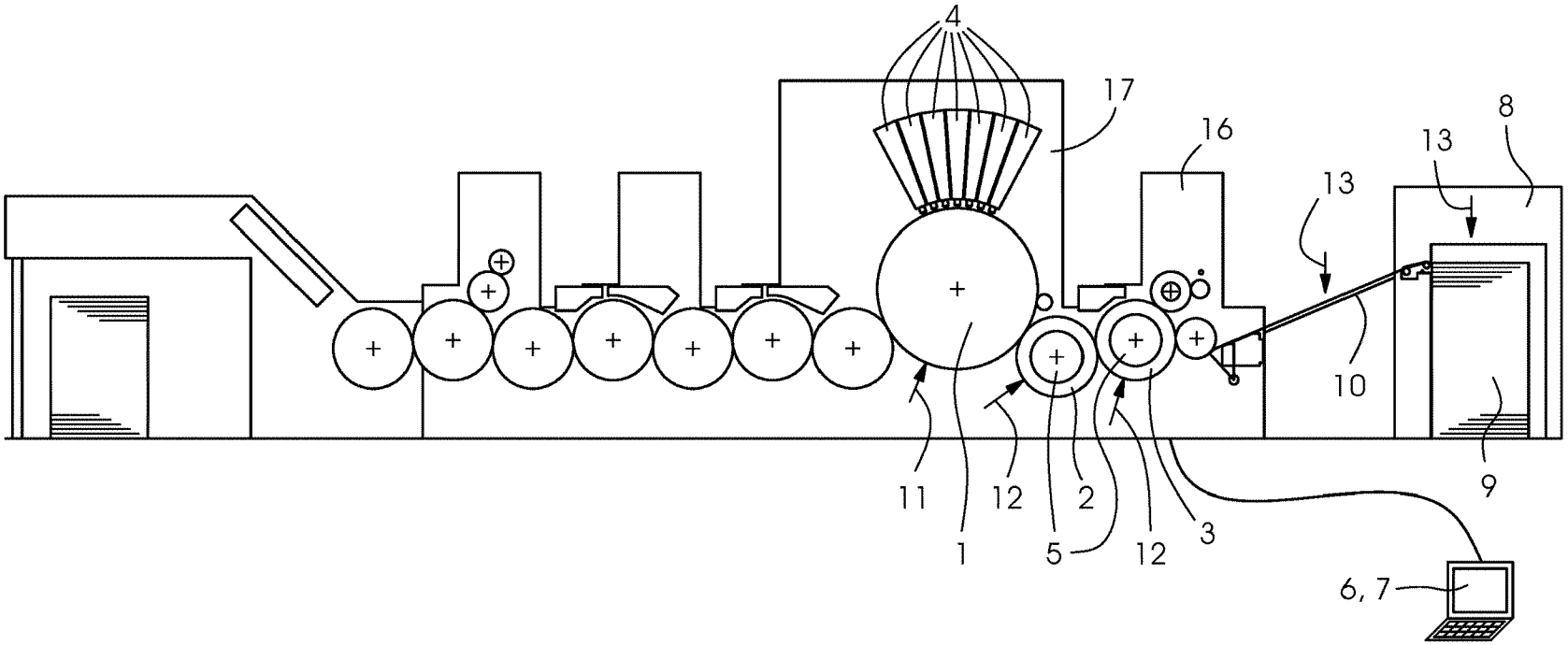
FIG. 1 is a diagrammatic, longitudinal-sectional view of a digital printing machine in its entirety.

Referring now to the figures of the drawings in detail and first, particularly, to FIG. 1 thereof, there is seen a digital printing machine including a printing unit 17 with multiple print heads 4 for inkjet printing. The print heads 4 are so-called print bars extending over the entire printing width. In order to produce a four-color print, the print heads 4 print different colors onto sheets, which are moved past the print heads 4 by a first cylinder 1. The digital printing machine further includes a sheet feeder 8 in which the sheets form a stack 9 before they are conveyed into a pre-coating unit 16 over a feed table 10. The pre-coating unit 16 applies a pre-coat over the entire surface to be printed on to obtain better print quality in the downstream inkjet printing operation in the printing unit 17.

Grippers of a second cylinder 2 receive the sheets from grippers of a third cylinder 3, which belongs to the pre-coating unit 16. The third cylinder 3 is a counter pressure cylinder that supports the sheets as they receive the pre-coat. The second cylinder 2 transfers the sheets from the grippers thereof to the grippers of the first cylinder 1.

A temperature control device 5 including a line system for circulating a temperature control fluid is integrated into the second cylinder 2. An associated electrical heating element may be located outside the second cylinder 2. The temperature control device 5 adjusts the temperature of a circumferential cylinder surface 15 (FIG. 2) of the second cylinder 2 that supports the respective sheet while the latter is being transported by the second cylinder 2. The heat transferred to the circumferential cylinder surface by the temperature control device 5 is in turn transferred from the circumferential cylinder surface to the sheet resting thereon, which is thus heated by the temperature control device 5.

The first cylinder 1 is assigned at least a first sensor 11 for measuring the temperature of the circumferential cylinder surface of the first cylinder 1. The first sensor 11 may initiate an automated machine stop when the temperature of the first cylinder 1 is too high. The second cylinder 2 is assigned a second sensor 12 for measuring the temperature of the respective sheet as it is transported from the third cylinder 3 to the first cylinder 1. The second sensor 12 is disposed next to the second cylinder 2 and directed towards the latter for a contact-free measurement of the temperature of the sheet transported thereon.

In a non-illustrated modified version, the second sensor 12 would be disposed next to the third cylinder 3 and directed towards the latter to measure the temperature of the sheet transported thereon in a contact-free way.

A plurality of third sensors 13 for measuring the temperature of the sheet are disposed in a row that is located either above the stack 9 or above the feed table 10. Both alternatives are shown together in FIG. 1. If the third sensors 13 are disposed above the feed table 10, they measure the temperature of the sheets while they are being transported on the feed table 10. If, in the other case, the third sensors are disposed above the stack 9, they measure the temperature of the respective uppermost sheet on the stack 9 before the sheet is conveyed to the feed table 10. The digital printing machine includes an electronic control device including a control element 6 and an initiation device 7.

Figure 2:
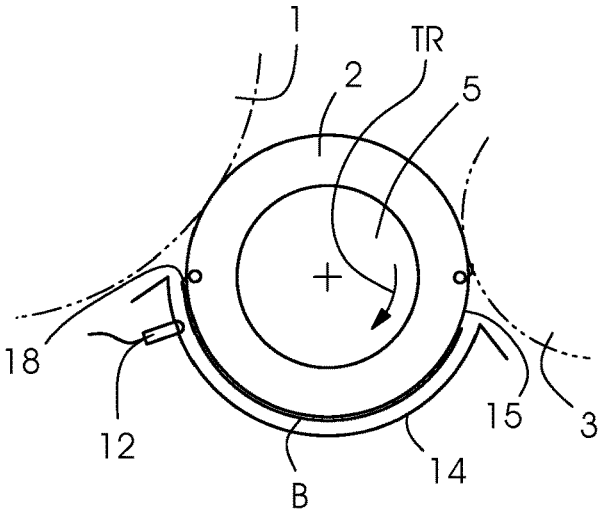
FIG. 2 is a cross-sectional view of cylinders of the digital printing machine.

FIG. 2 shows a pressing device 14 disposed next to the second cylinder 2 equidistantly relative to the circumferential cylinder surface 15. The pressing device 14 is disposed underneath the second cylinder 2 and has nozzles (not shown in the drawing) that emit blown air in the direction of the second cylinder 2 to press the sheet resting thereon against the cylinder 2. A sheet B, which is transported past the pressing device 14 by the grippers 18 of the second cylinder 2 is wrapped snugly around the circumferential cylinder surface 15 over the entire sheet length and sheet width by using the pressing device 14. The pressing device 14 is embodied as a blown-air guide plate or a blown-air box.

The two cylinders 1, 2 have a common point of sheet transfer in which the sheet B is transferred from the grippers 18 of the second cylinder 2 to the grippers of the first cylinder 1. The two cylinders 1, 2 form a wedge-shaped entrance region upstream of this common point of sheet transfer as viewed in the direction of rotation of the cylinder. One end of the pressing device 14 extends into the entrance region. The second sensor 12 is disposed on the pressing device 14 in the region of an end of the pressing device 14 extending into the entrance region. The second sensor 12 thus measures the temperature of the sheet B at a location a short distance upstream of the point of sheet transfer. The second sensor 12 is inserted between the blown-air nozzles of the pressing device 14 in the concave guide surface thereof and is directed towards the second cylinder 2 in a radial direction thereof. While the sheet B is transported on the second cylinder 2, the direction of transport TR of the sheet B corresponds to the direction of rotation of the second cylinder 2.

Figure 3:
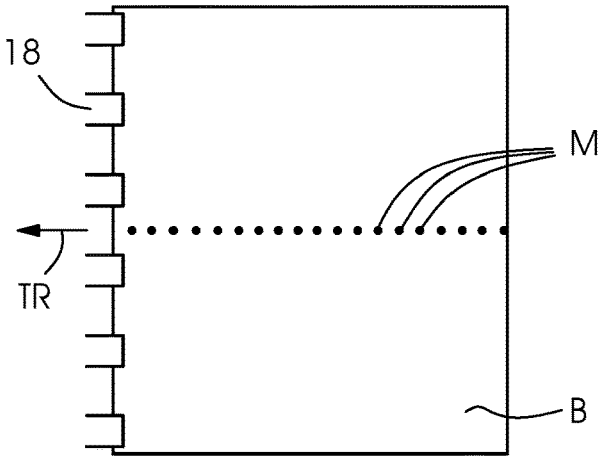
FIG. 3 is a top-plan view of a print sheet on one of the cylinders.

FIG. 3 is a view of the sheet B from below as it is being transported by the second cylinder 2. A row of imaginary measuring locations M on the sheet B extends in the direction of transport TR of the sheet B or in a direction parallel thereto. The second sensor 12 successively measures the temperature of the sheet B in these measuring points M. In the illustrated example, the row is located at the center of the width of the sheet B and extends over the entire length thereof. The temperature values measured at the measuring points M together form a temperature profile of the sheet B, which is shown in FIG. 4.

Figure 4:
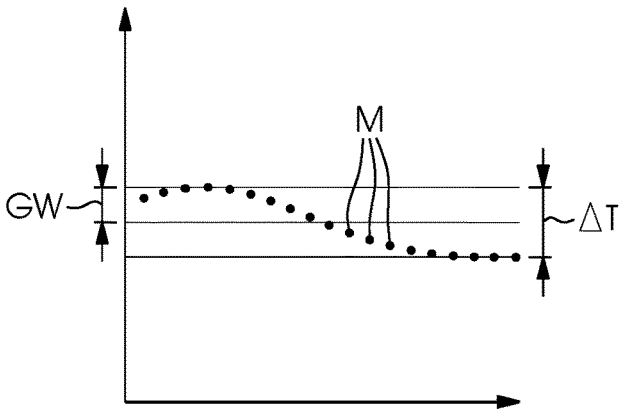
FIG. 4 is a diagram of a temperature profile of the sheet of FIG. 3.

FIG. 4 illustrates a scatter plot in which the time of measurement is indicated on the abscissa and the measured temperatures of the sheet B are indicated on the ordinate. The measured values shown in the diagram correspond to the measuring points M in FIG. 3. FIG. 4 shows that in the leading half of the sheet B as viewed in the direction of transport TR, the temperature assumes higher values than in the trailing half of the sheet B. This unintentional effect results from the fact that the grippers 18 of the second cylinder 2 hold the leading edge of the sheet B, causing the front sheet half facing towards the region of the leading edge to wrap more snugly around the circumferential cylinder surface 15, which is heated by the temperature control device 5. This means that the heat transfer from the second cylinder 2 to the sheet B is more intense in the front sheet half. There are temperature differences $\Delta T$ between the measured values of the sequence. The diagram indicates the maximum temperature difference ΔT.

The initiation device 7 has been programmed in a corresponding way to define a threshold GW for the temperature difference ΔT. If one of the temperature differences ΔT exceeds the threshold GW, the initiation device 7 will automatically initiate a warning signal and a sheet transport stop. The alarm signal may be displayed on a screen of the initiation device 7. As a consequence of the sheet transport stop, the sheet feeder 8 no longer conveys sheets B from the stack 9 into the downstream section of the machine.

Figure 5:
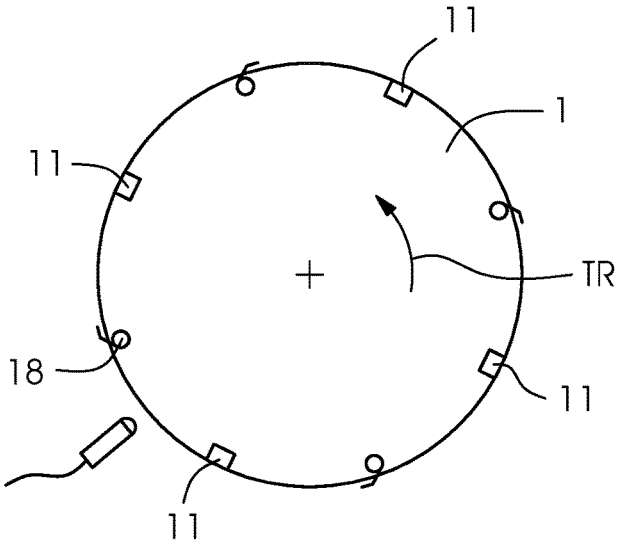
FIG. 5 is a cross-sectional view of one of the cylinders of FIG. 2 together with a sensor system.

FIG. 5 shows that the first cylinder 1 is subdivided into four quadrants. Every quadrant has a row of grippers 18 at its leading edge for holding the leading edge of the sheet B. Every row of grippers 18 is followed by a circumferential support surface for the sheet B. This means that the first cylinder 1 has four sheet-supporting surfaces. The first sensor 11 for measuring the temperature of the respective quadrant of the first cylinder 1 is disposed in the region of every quadrant. The first sensors 11 are disposed immediately underneath the sheet-supporting surfaces. The four first sensors 11 disposed inside the cylinder measure the temperature of the first cylinder 1 through contact with the latter and may be provided in addition or as an alternative to the external first sensor 11 disposed next to the first cylinder 1 and directed towards the latter to measure the cylinder temperature in a contact-free way. As the first cylinder 1 rotates, the external first sensor 11 successively measures the circumferential surface temperature of all four sheet-supporting surfaces. The external first sensor 11 and/or the internal first sensors 11 signal the measured temperatures to the initiation device 7, which initiates a warning signal and/or a machine stop when a programmed threshold of the temperature difference between regions 19, 20 (FIG. 6) is exceeded.

Figure 6:
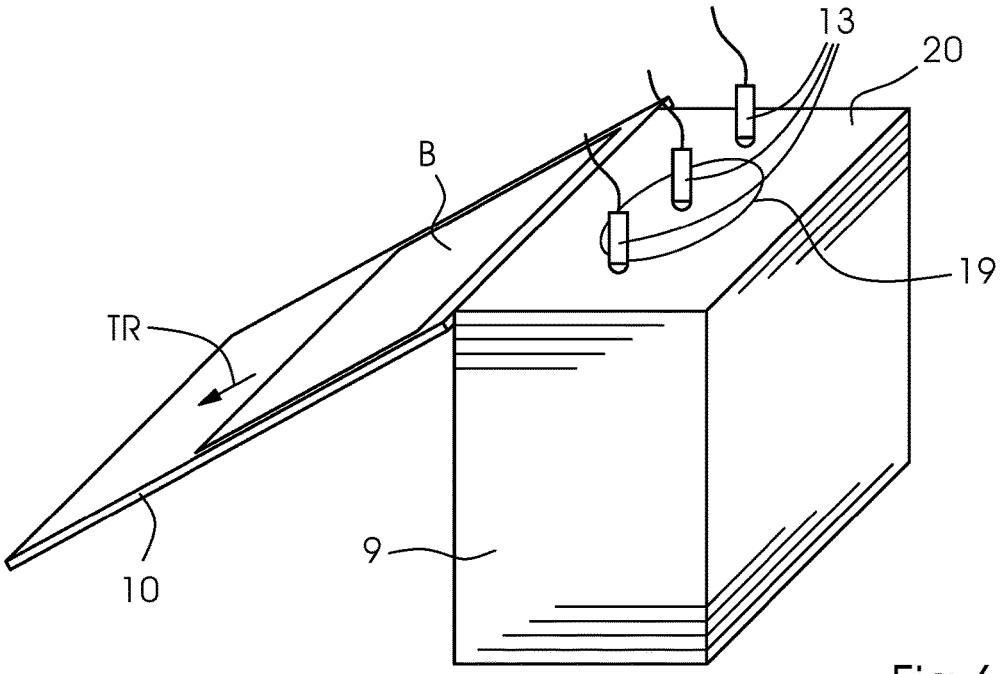
FIG. 6 is a perspective view of a sheet feeder of the digital printing machine of FIG. 1 together with a further sensor system.

FIG. 6 illustrates that the stack 9 has a core zone 19 surrounded by a marginal zone 20. Acclimatization takes longer in the core zone 19 than in the marginal zone 20. In practice, it often occurs that stacks are used in a printing operation on the machine although their core has not completely acclimatized. This runs the risk of an intolerable deterioration of the quality of the print because the temperature differences between the core and marginal zones are too great. This problem is solved by providing the third sensors 13 as shown in FIG. 6. The central third sensor 13 is directed towards the core zone 19 and the outer third sensors 13 are directed towards the marginal zone 20. The third sensors 13 measure the temperatures in the two zones 19, 20 in every sheet B and signal them to the initiation device 7. The latter initiates a warning signal and/or a machine stop when the temperature difference between the two zones 19, 20 exceeds a programmed threshold.

In accordance with a non-illustrated modification, the third sensors 13 are not disposed above and directed towards the stack but above the feed table 10. In this case, the temperature difference between the zones 19, 20 is likewise measured in every sheet B, namely immediately after the sheets B are removed from the stack 9.

The following is a summary list of reference numerals and the corresponding structure used in the above description of the invention.

LIST OF REFERENCE SYMBOLS

1 first cylinder
2 second cylinder
3 third cylinder
4 print head
5 temperature control device
6 control element
7 initiation device
8 sheet feeder
9 stack
10 feed table
11 first sensor
12 second sensor
13 third sensor
14 pressing device
15 circumferential cylinder surface
16 pre-coating unit
17 printing unit
18 gripper
19 core zone
20 marginal zone
B sheets
GW threshold
M measuring point
TR direction of transport
ΔT temperature difference

The invention claimed is:

1. A digital printing machine, comprising:
a first cylinder for transporting sheets;
a second cylinder transferring the sheets directly to said first cylinder;
a third cylinder transferring the sheets directly to said second cylinder;
at least one inkjet print head directed towards said first cylinder for printing on the sheets disposed on said first cylinder;
at least one first sensor for measuring a temperature of said first cylinder;
a second sensor for measuring a temperature of the sheets while being transported by said second cylinder or by said third cylinder;
at least one temperature control device for controlling a temperature of said sheets before transferring the sheets to said first cylinder; and
a control element for adapting a temperature of the sheets to the temperature of said first cylinder, said control element being connected to said first sensor, said second sensor and said temperature control device.

2. The digital printing machine according to claim 1, wherein said temperature control device is integrated into said second cylinder.

3. The digital printing machine according to claim 1, wherein said temperature control device is integrated into said third cylinder.

4. The digital printing machine according to claim 1, wherein said second sensor is controlled for measuring a temperature of a respective sheet in a plurality of measuring points forming a row extending in a direction of transport of the respective sheet.

5. The digital printing machine according to claim 4, which further comprises an initiation device connected to said second sensor, said initiation device initiating a warning signal or a sheet transport stop when a temperature difference between said measuring points exceeds a defined threshold.

6. The digital printing machine according to claim 1, which further comprises a plurality of third sensors for measuring a temperature of the sheets, said third sensors being disposed in a row extending perpendicular to a direction of transport of the sheets.

7. The digital printing machine according to claim 6, which further comprises a sheet feeder in which said third sensors are disposed.

8. The digital printing machine according to claim 7, which further comprises a feed table, said third sensors being directed towards a stack formed by the sheets in said sheet feeder or towards said feed table.

9. The digital printing machine according to claim 1, which further comprises a circumferential cylinder surface and a pressing device for pressing the sheets against said circumferential cylinder surface, said pressing device being temperature-controlled by said temperature control device.

10. The digital printing machine according to claim 9, wherein said pressing device is a guide plate with blown-air nozzles for applying pressure without sheet-contact or an endless revolving belt for applying pressure with sheet contact.

* * * * *